United States Patent [19]

Zirps

[11] 4,212,165

[45] Jul. 15, 1980

[54] HYDRAULIC CONTROL ARRANGEMENT

[75] Inventor: Wilhelm Zirps, Hemmingen, Fed. Rep. of Germany

[73] Assignee: Robert Bosch GmbH, Stuttgart, Fed. Rep. of Germany

[21] Appl. No.: 14,879

[22] Filed: Feb. 26, 1979

[30] Foreign Application Priority Data

Feb. 25, 1978 [DE] Fed. Rep. of Germany ..... 2808196

[51] Int. Cl.[2] ..... F15B 13/06; F15B 13/09

[52] U.S. Cl. ..... 60/486; 91/530

[58] Field of Search ..... 60/486, 421, 468, 422; 91/508, 525, 530

[56] References Cited

U.S. PATENT DOCUMENTS

| | | | |
|---|---|---|---|
| 3,183,977 | 5/1965 | Heckenkamp et al. | 60/421 X |
| 3,782,249 | 1/1974 | Drone | 91/420 X |
| 4,112,821 | 9/1978 | Bianchetta | 60/486 X |

*Primary Examiner*—Edgar W. Geoghegan

*Attorney, Agent, or Firm*—Michael J. Striker

[57] ABSTRACT

A hydraulic control system for distributing pressure fluid to at least two systems, that is a first system including a first pump supplying pressure fluid through a first conduit to a first consumer and a second system including a second pump for supplying pressure fluid to a second conduit, in which a plurality of multiple position valves are arranged, each movable between a neutral position providing free flow of fluid through the second conduit and at least one working position respectively directing pressure fluid to the additional consumer respectively connected to said plurality of multiple position valves. A regulating valve is located in the first conduit and the second conduit is connected by a cross-conduit to the first conduit at a point upstream of the regulating valve therein. A bypass circuit in which a valve controlled by the fluid pressure in the second conduit is located leads from the second conduit to the inlet of the first pump so that when none of the additional consumers is actuated only a very small fluid stream passes through the second conduit and the multiple position valves to thereby reduce the energy losses.

8 Claims, 3 Drawing Figures

HYDRAULIC CONTROL ARRANGEMENT

BACKGROUND OF THE INVENTION

The present invention relates to a hydraulic control arrangement with at least two pumps which individually, or at corresponding energy requirements together, feed pressure fluid to a plurality of hydraulic comsumers over a plurality of multiple position valves respectively coordinated with the hydraulic consumers. In known systems of the aforementioned kind with pumps delivering constant amounts of fluid the change of the fluid stream to the consumer is only possible by a throttled discharge of the not-necessary pressure fluid stream into a tank. Depending on the construction of the multiple position valves (positive or negative overlapping) the unused amount of pressure fluid which is conducted to the tank is thereby throttled to the throttle loss in the multiple position valves of higher pressure or even to the opening pressure of a pressure limiting valve. In such a system the total fluid stream flows through all multiple position valves which are arranged one behind the other. The pressure loss and the therewith connected energy losses are in the known systems correspondingly high.

SUMMARY OF THE INVENTION

It is an object of the present invention to provide a hydraulic control arrangement of the aforementioned kind which avoids the disadvantages of such arrangements known in the art.

It is a further object of the present invention to provide a hydraulic control arrangement of the aforementioned kind in which the energy losses are smaller than in such control arrangements known in the art.

It is an additional object of the present invention to provide a hydraulic control arrangement in which the allotment of pressure fluid to the various consumers may be carried out in a better way than in such arrangments known in the art.

With these and other objects in view, which will become apparent as the description proceeds, the hydraulic control arrangement according to the present invention for distribution of pressure fluid to at least two systems, that is a first system including a first source of pressure fluid constituted by a pump having an inlet communicating with a fluid-filled tank and an outlet, a first hydraulic consumer, a first conduit connecting the outlet of the first pump to the first consumer and a fluid flow regulating valve in the first conduit, and a second system including a second source of pressure fluid constituted by a second pump having an inlet communicating with the aforementioned tank and an outlet, a plurality of additional hydraulic consumers, a second conduit connecting the outlet of the second pump to the plurality of additional consumers, a plurality of multiple position valves in the second conduit, one for each of the additional hydraulic consumers and each movable between a neutral position and at least one working position and each providing in the neutral position free flow of fluid through the second conduit. The control arrangement includes further a cross-conduit connecting the first conduit upstream of the flow regulating valve with the second conduit, a branch conduit connected at one end to the second conduit upstream of the connection of the latter to the cross-conduit, a bypass valve in the aforementioned branch conduit movable between a first position permitting flow of fluid through the branch conduit and a second position preventing such flow, spring means acting on one end of the bypass valves and biasing the latter to the first position and a control pressure acting on the other end of the bypass valve for biasing the latter to the second position. The aforementioned control pressure corresponding to the respective higher consumer pressure of an additional hydraulic consumer connected by a respective multiple position valve to the second conduit, whereby when none of the additional hydraulic consumers is connected to the second conduit only a partial fluid stream from one of the pumps will flow through the second system.

The aforementioned branch conduit is connected at its other end to the inlet of the first pump.

The arrangement includes further a control conduit connected at one end to the other end of the bypass valve, a further conduit for each multiple position valve and connecting the second conduit with the aforementioned control conduit in the working position of the respective multiple position valve, and a one-way valve in the further conduit permitting flow from the multiple position valve into the control conduit while preventing flow in the opposite direction, and a conduit branching off from the control conduit and connected to the other end of the bypass valve for transmitting the control pressure in the control conduit to the aforementioned other end of the bypass valve.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
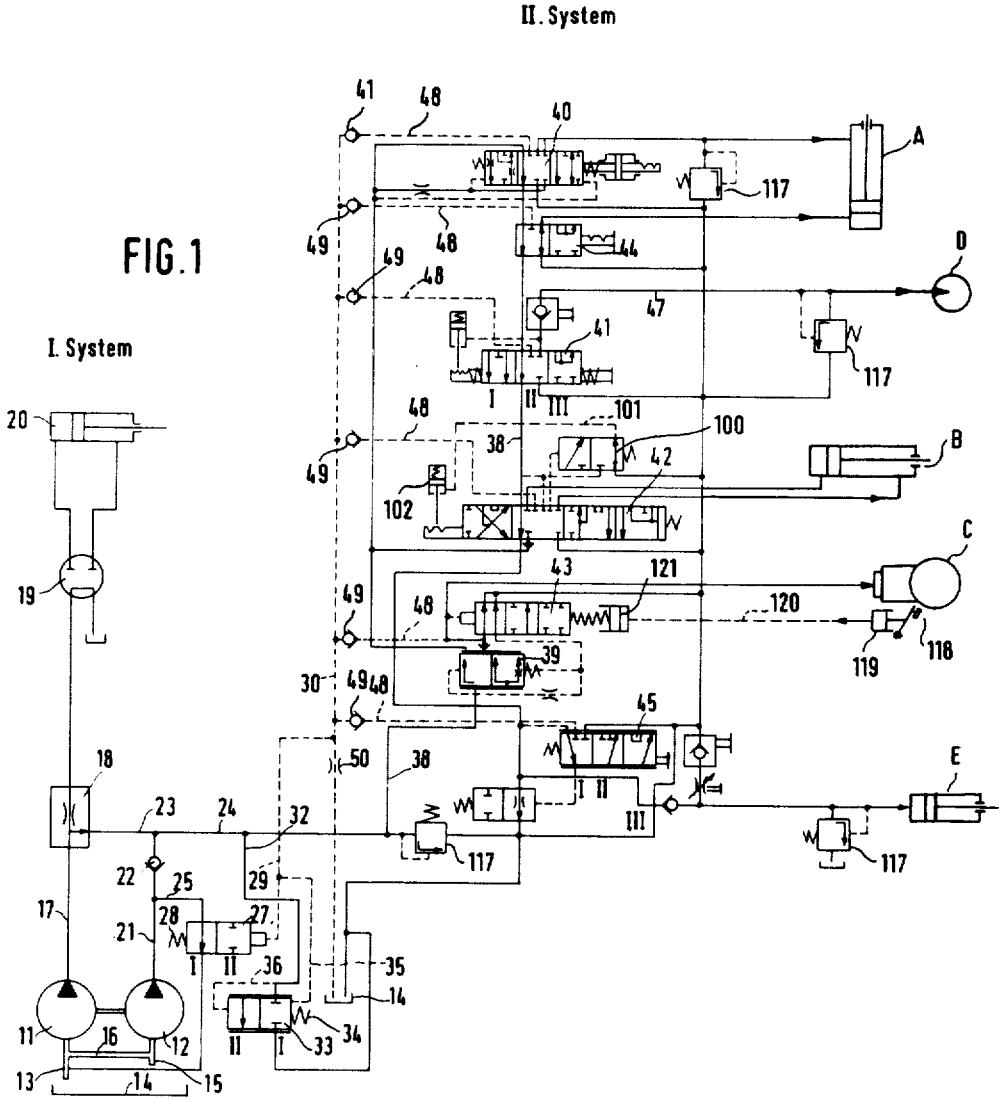
FIG. 1 schematically illustrates a first hydraulic control arrangement according to the present invention.

Referring now to the drawing, and more specifically to FIG. 1 of the same, in which a first embodiment of a hydraulic control arrangement for distribution of pressure fluid to at least two systems is schematically illustrated, it will be seen that this control arrangement includes two pumps 11 and 12, which preferably are driven from a common drive motor, not shown in the drawing. Instead of only two pumps, additional pumps may also be provided in this control arrangement. The pump 11 sucks fluid, for instance oil, over a conduit 13 from a container or tank 14. The pump 12 likewise sucks fluid over a suction conduit 15 from the aforementioned tank 14. The two suction conduits 13 and 15 are connected by a conduit 16. The pump 11 conveys the fluid under pressure through a first conduit 17 in which a fluid stream regulating valve 18 and a control valve 19 of known constructions are located to a first hydraulic consumer 20 shown as a double-acting cylinder-and-piston unit which may for instance serve for the hydrostatic steering of an automotive vehicle for agricultural purposes.

The pump 12 conveys fluid under pressure into a conduit 21 which over a one-way valve 22 leads to a conduit 24. A cross-conduit 23 connects the first conduit upstream of the flow regulating valve 18 with the conduit 24 so that pressure fluid supplied by the pumps 11 and 12 may flow into the conduit 24. A branch conduit 25 connected at one end to the conduit 21, upstream of the one-way valve 22 located in the latter, is connected at the other end thereof to the suction conduit 13 of the pump 11. A bypass valve 27 is located in the branch conduit 25 movable, as will be explained later on, between a position I permitting flow of fluid through the branch conduit 25 and a position II preventing such flow. The bypass valve 27 is acted upon at one end by a spring 28 biasing the valve to the position I and on the opposite end by the pressure in a conduit 29 which is connected to a control conduit 30 and biasing the valve 27 to the position II.

An additional conduit 32 branches off from the conduit 24 and leads over a regulating valve 33 to the tank 14. The regulating valve 33 is movable between a position I preventing flow of fluid through the conduit 32 and a position II permitting such flow. The regulating valve 33 is acted upon at one end by a spring 34, as well as by the pressure in a conduit 35 which is connected to the aforementioned conduit 29 so as to bias the valve 33 to the position I. Onto the other end of the valve 33 acts the pressure of a control conduit 36, connected to the aforementioned conduit 32, so as to bias the valve 33 to the position I. The regulating valve 33 has a steady transition between the blocking position I and the fully open position II.

A conduit 38 is connected to the conduit 24 and over a regulating valve 39 to a plurality of multiple position valves 40–45. All of these multiple position valves provide in the neutral position thereof free flow of pressure fluid there-through (open center valves); the conduit 38 leads over these valves to the tank 14. A plurality of hydraulic consumers A–E are connected over consumer conduits 47, as for instance shown for the multiple position valve 41, to the plurality of multiple position valves 40–45. These hydraulic consumers may be double-acting cylinder-and-piston units as shown for the hydraulic consumers A and B, a single-acting cylinder-and-piston unit as shown at E, or a hydraulically operated brake drum as schematically shown at C. The plurality of multiple position valves 40–45 may be moved from their neutral position to working position in various well-known ways and the manner in which these valves are moved between the positions thereof is immaterial for the present invention. As schematically illustrated for the multiple position valve 42, the latter may be operated from an operating valve 100, which over a control conduit operates a valve locking mechanism 102 of known construction schematically illustrated in FIG. 1. Another way of operating the multiple position valves is indicated for the multiple position valve 43 connected to the hydraulic consumer C in form of a hydraulic brake drum. This valve 43 is operated from a brake pedal 118 acting on the usual brake cylinder 119, from which pressure fluid is transmitted over a conduit 120 to an operating cylinder 121 for moving the valve 43 to the various positions thereof. As mentioned before, the manner in which the various multiple position valves 40–45 are moved between the positions thereof is immaterial for the present invention and any well-known control means for moving these multiple position valves between the various positions thereof may be used in the arrangement according to the present invention. As indicated at the valve 41 the same has a neutral position II and two working positions I and III at opposite sides of the neutral position. Each of the multiple position valves is connected over a conduit 48 in which a one-way valve 49 is located to the control conduit 30. A throttle 50 is located in the control conduit 30 downstream of the connection of the conduit 29 to the control conduit 30. A plurality of over pressure valves 117 are arranged in circuit with the consumers.

When none of the multiple position valves is moved from its neutral position to a working position thereof, then the control conduit 30 is practically pressureless, so that the bypass valve 27 will be in its throughflow position I, whereas the regulating valve 33 will be held in its blocking position I. The fluid stream produced by the preferably smaller pump 11 divides at the fluid stream regulating valve 18 in a constant partial stream which flows to the hydraulic consumer 20 and a residual stream which flows through the cross-conduit 23. This residual stream passes from the cross-conduit 23, over the conduit 24 into the conduit 38 forming with the conduit 24 the second conduit of the arrangement and flows then through the plurality of sequentially arranged multiple position valves 40–45 and passes finally into the tank 14. This relatively small residual stream will produce during its flow through the aforementioned conduits and especially through the plurality of multiple position valves only a small flow resistance and therewith only small energy losses. The pump 12 pumps fluid only into the conduit 25 and over the bypass valve 27 into the suction conduit 13 of the pump 11. This will assure that the pump 12 will also receive during idling operation the necessary amount of pressure oil for the cooling thereof.

If now one of the hydraulic consumers, for instance the consumer D, is supplied with pressure fluid by moving the valve 41 from its neutral position II to its working position III, then pressure fluid flows from the conduit 38 into the consumer conduit 47 and also in the conduit 48. The one-way valve 49 in the conduit 48, connected to the valve 41, opens and pressure is built-up in the control conduit 30, which corresponds to the consumer pressure in the conduit 47. The pressure in the control conduit 30 is transmitted over the conduit 29 to the bypass valve 27 which is thereby moved, against the force of the spring 28, to its blocking position II. At this moment the pressure fluid pumped by the pump 12 passes over the one-way valve 22 likewise into the conduit 24 and the consumer receives thereby a corresponding higher amount of pressure fluid.

At the same time, the regulating valve 33 is acted upon over the conduit 35 by the consumer pressure prevailing in the control conduit 30. On the other hand, it is also acted upon by the slightly unthrottled pressure in the conduit 36 so that it will be moved to an intermediate position (throttling position) to thereby maintain a predetermined pressure difference over the actuated multiple position valve, or multiple position valves, including the conduits connected thereto. In this way, the pump 12 is not suddenly connected into the fluid circuit with its full capacity, but gradually in accordance with the opening of the throughflow cross-section in the corresponding multiple position valve, which is also not suddenly opened to the full available cross-section.

In the region of the fine control of one actuated multiple position valve, which will occur when the latter is adjusted for a relatively small throughflow cross-section, for instance over a fine control chamfer, both pumps will pump fluid into the conduit 24 and the fluid circuit connected thereto, and to the connected consumer flows then only the amount of pressure fluid which is determined by the flow-through opening of the respective multiple position valve, whereas the remainder of the pressure fluid pumped by the two pumps will flow over the regulating valve 33 to the tank 14. This will assure an exact metering of the amount of pressure fluid to the respective consumer in dependence only on the position of the multiple position valve connected thereto.

Figure 2:
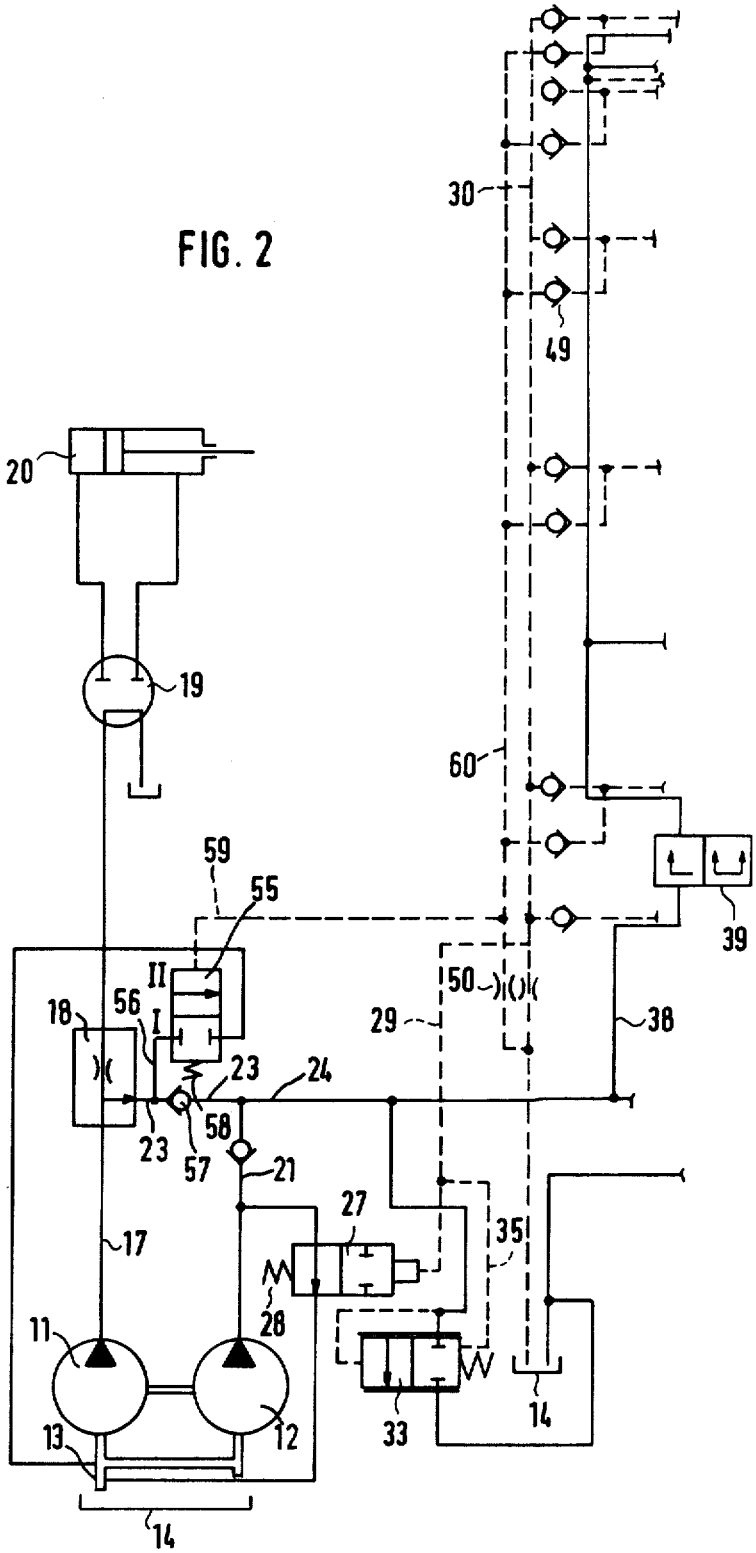
FIG. 2 illustrates a modification of the arrangement shown in FIG. 1.

The embodiment shown in FIG. 2 differs from the above-described embodiment illustrated if FIG. 1 in that there is provided an additional control valve 55 connected by a conduit 56 to the cross-conduit 23. A one-way valve 57 is arranged in the cross-conduit 23 between the point of connection of the conduit 56 and the conduit 21 to the conduit 23. The one-way valve 57 permits flow of pressure fluid through the conduit 23 from the conduit 17 to the conduit 24, while preventing flow of pressure fluid in the opposite direction. The control valve 55 has a blocking position I and a flow-through position II. A spring 58 acts at one end of the valve 55, biasing the latter to the position I and on the other side acts the fluid pressure from a conduit 59 connected to a control conduit 60 to thereby bias the valve 55 to the position II. The conduit 56 leads over the valve 55 to the suction conduit 13 of the pump 11. The control conduit 60 may be connected to the control conduit 30 or to any of the plurality of additional hydraulic consumers, not shown in FIG. 2. It is to be understood that the conduit 38 connected to the conduit 24 leads over the regulating valve 39 to a plurality of multiple position valves as shown in FIG. 1, which in turn are connected to a plurality of consumers not shown in FIG. 2.

If pressure is built up in the control conduit 60, then the control valve 55 is moved against the force of the spring 58, from its blocking position I to the flow-through position II. In this position, the residual fluid stream, passed by the fluid stream regulating valve 18 into the conduit 23, will flow back into the suction conduit 13 of the first pump 11 over the conduit 56. In this way it is possible to decouple both pumps, which is advantageous in view of the energy losses during the operation of two consumers over a long period.

Figure 3:
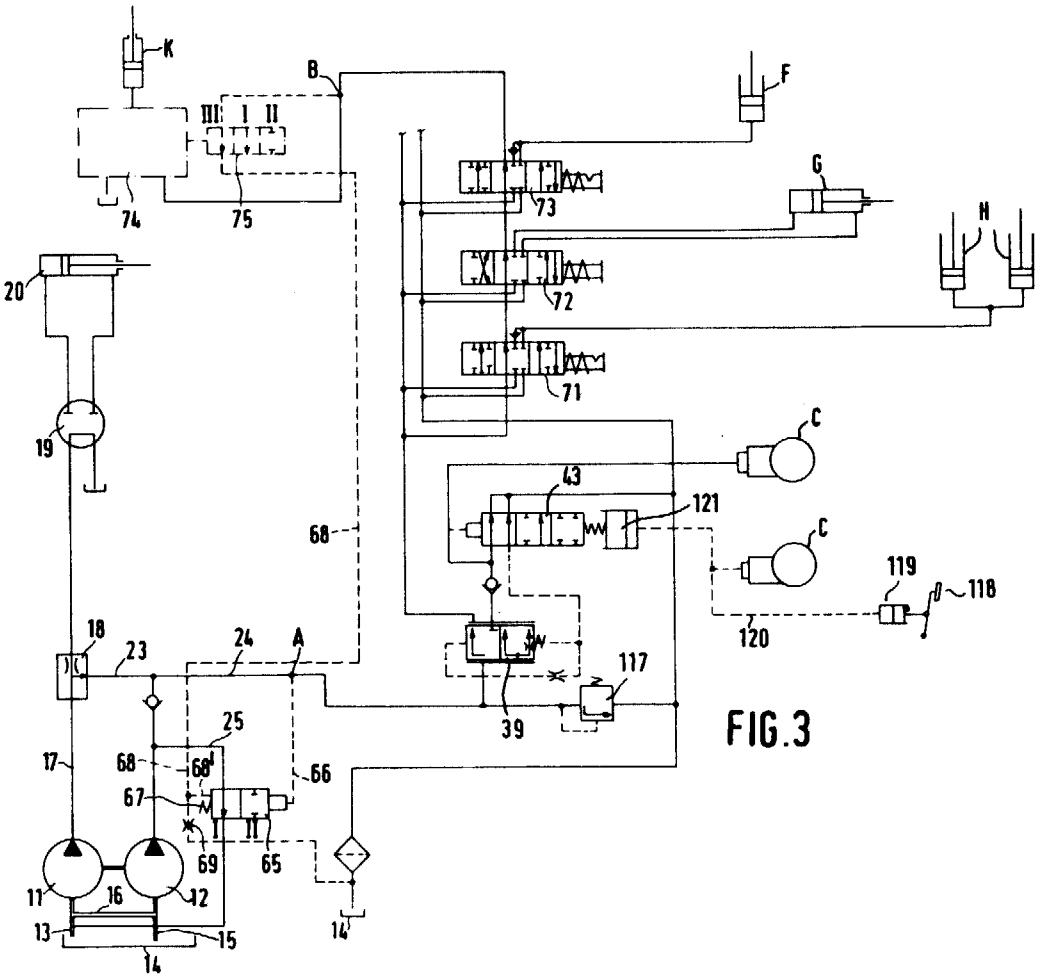
FIG. 3 illustrates a further embodiment of a control arrangement according to the present invention.

FIG. 3 illustrates a further embodiment according to the present invention. Elements shown in FIG. 3 which perform the same function as the elements shown in FIG. 1 are designated in FIG. 3 with the same reference numerals. There is again provided a bypass valve 65 which has a blocking position II and a throughflow position I. This bypass valve 65 is, however, acted upon on one side thereof over a conduit 66 which is connected to the conduit 24. On the other side of the bypass valve 65 acts a spring 67, as well as the pressure from a control conduit 68 which leads over a throttle 69 to the tank 14. From the conduit 68 leads a conduit 68' to the bypass valve 65.

The conduit 24 leads over a regulating valve 39 to a plurality of multiple position valves 43 and 71–74 which may be constructed and operated in the manner as described above between a neutral flow-through position and working positions to supply in their working position a plurality of additional consumers C, F, G, H and K. The hydraulic consumers C are again schematically indicated as being hydraulically operated brake drums and the valve 43 is operated, in the manner as described in connection with FIG. 1, from a brake pedal 118 and the elements connected between the brake pedal and the valve 43. The consumer K connected to the multiple position valve 74 is shown as a single-acting cylinder-and-piston unit which may be used for raising and lowering of a plow, not shown in the drawing. The control conduit 68 branches off from the conduit 24 at a point B downstream of the multiple position valve 73. The control conduit 68 passes downstream of the point B through a multiple position valve 75 which is coordinated with the valve 74.

The pump 11 again primarily pumps fluid over the fluid stream regulating valve 18 and the valve 19 to the hydraulic consumer 20 and secondarily into the hydraulic working circuit which is connected to the conduit 24. The pump 12 is cut out, that is the fluid stream pumped by the pump 12 flows with very small pressure loss over the bypass valve 65 to the suction conduit 13 of the pump 11. The residual fluid stream not required by the hydraulic consumer 20 and branched off from the conduit 17 upstream of the fluid stream requlating valve 18 passes again through the plurality of successively arranged multiple position valves and the control device 74 of the consumer K. The multiple position valves are constructed in such a manner that, upon actuation of one of these valves, the neutral throughflow to the following consumer is interrupted and over a separate channel pressure fluid is conducted to a pressure space of the operated consumer. In the control device 74 pressure fluid is guided to the cylinder of the hydraulic consumer K in a known manner by means of closing the throughflow over a one-way valve. Over the control conduit 68 and the multiple position valve 75, which for instance may be an additional control edge on the control slide of the control device 74, the pressure at the inlet of the control device 74 is transmitted through the control conduit 68 onto the left side of the bypass valve 65.

In the position of the various multiple position valves shown in FIG. 3, none of the hydraulic consumers C and F–K are actuated, so that the residual stream of the pump 11 flows through all of the multiple position valves. The spring 67 of the bypass valve 65 is harmonized to the flow-through resistance of the system between the points A and B of the conduits 23, 24 and that of the conduit 66, so as to hold the bypass valve 65 in its throughflow position I. If now one of the consumers connected to the conduit 24 between the points A and B is actuated by operation of the multiple position valve coordinated therewith, then the respective consumer pressure will act in the control conduit 66, whereas the control conduit 68 will remain pressureless. The bypass valve 65 will now be brought, due to the pressure prevailing in the conduit 66, to its blocking position II so that the pump 12 will likewise furnish pressure fluid into the conduit 24.

If the regulating device 74 is actuated, whereby the multiple position valve 75 is in its throughflow position I, the bypass valve 65 remains in its through-flow position I since at the points A and B only a low pressure difference prevails which is determined by the throughflow resistance in the conduits and the multiple position valves. Only when the multiple position valve 75 is brought to the blocking position II will the conduit 68 be closed and over the throttle 69 relieved toward the tank 14. The pressure prevailing in the conduit 66 brings now the bypass valve 65 to its blocking position II and the pump 12 will again pump pressure fluid into the conduit 24.

In summarizing the essential features of the present invention, it is pointed out that if none of the additional consumers is actuated, only the fluid stream pumped by one of the pumps or a part thereof flows through the plurality of multiple position valves which are arranged one after the other and the conduits connected thereto. The energy losses are essentially reduced due to the essentially reduced pressure drop and the small throughflow amount of fluid. This small fluid stream is at the same time the exciting fluid stream which provides the starting energy for the connection of the second, respectively additional pump.

The selective connection of other pumps and the thereby possible combination of the fluid streams permits a better adaptation of the total fluid stream to the consumers. The hydraulic disconnection of the pump permits separate hydraulic circuits in which a plurality of hydraulic consumers may be operated individually or simultaneously with different operating pressures.

It will be understood that each of the elements described above, or two or more together, may also find a useful application in other types of hydraulic control arrangements differing from the types described above.

While the invention has been illustrated and described as embodied in a hydraulic control arrangement for distribution of pressure fluid to at least two systems, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic control arrangement for distribution of pressure fluid to at least two systems, that is a first system including a first source of pressure fluid constituted by a pump having an inlet communicating with a fluid-filled tank and an outlet, a first hydraulic consumer, a first conduit connecting said outlet of the first pump to said first consumer, and a fluid-flow regulating valve in said first conduit and a second system including a second source of pressure fluid constituted by a second pump having an inlet communicating with said tank and an outlet, a plurality of additional hydraulic consumers, a second conduit connecting said outlet of the second pump to said plurality of additional consumers, a plurality of multiple position valves in said second conduit, one for each of said additional hydraulic consumers and each movable between a neutral position and at least one working position and each providing in said neutral position free flow of fluid through said second conduit; a cross-conduit connecting said first conduit upstream of said fluid-flow regulating valve with said second conduit; a branch conduit connected at one end to said second conduit upstream of the connection of the latter to said cross-conduit; a bypass valve in said branch conduit movable between a first position permitting flow of fluid through said branch conduit and a second position preventing such flow; spring means acting at one end of said bypass valve and biasing the latter to said first position and a control pressure acting on the other end of said bypass valve for biasing the latter to said second position, said control pressure corresponding to the respective higher consumer pressure of an additional hydraulic consumer connected by the respective multiple position valve to said second conduit, whereby when none of said additional hydraulic consumers is connected to said second conduit only a partial fluid stream from one of said pumps will flow through said second system.

2. A control arrangement as defined in claim 1, wherein said branch conduit is connected at its other end to said inlet of said first pump.

3. A control arrangement as defined in claim 2, and including a control conduit connected at one end to said other end of said bypass valve, a further conduit for each multiple position valve and connecting said second conduit with said control conduit in said working position of the respective multiple position valve, and a one-way valve in said further conduit permitting flow of fluid from said multiple position valve into said control conduit while preventing fluid flow in the opposite direction, and a conduit branching off from said control conduit and connected to said other end of said bypass valve for transmitting the pressure in said control conduit to said other end of said bypass valve.

4. A control arrangement as defined in claim 3, and including an additional conduit branching off from said second conduit and leading to said tank, a regulating valve in said additional conduit movable between a first position preventing flow of fluid from said second conduit to said tank and a second position permitting such flow, a conduit branching off from said additional conduit and directing fluid to one end of said regulating valve for biasing the latter to said second position, a spring acting on the other end of said regulating valve and biasing the same to said first position and a conduit branching off from said control conduit and directing fluid also to the other end of said regulating valve and supporting the action of said spring for biasing said regulating valve to said first position.

5. A control arrangement as defined in claim 4, and including a throttle in said control conduit downstream of the connection of the conduits leading respectively to the other end of said bypass valve and said other end of said regulating valve.

6. A control arrangement as defined in claim 3, and including a second control conduit connected to said multiple position valves, a bypass conduit connected at one end to said cross-conduit and at the other end to said inlet of said first pump, and an additional control valve in said bypass conduit movable between a first position preventing flow of fluid through said bypass conduit and a second position permitting such flow, a conduit leading from said second control conduit to one end of said additional control valve for transmitting said fluid pressure in said second control conduit to said one end of said additional control valve for biasing the latter to said second position, and a spring acting on the other end of said additional control valve for biasing the latter to said first position.

7. A control arrangement as defined in claim 1, wherein said first and said second pump each deliver a constant amount of fluid per time unit, and wherein the amount of fluid delivered per time unit by said first pump is smaller than said fluid delivered by said second pump.

8. A control arrangement as defined in claim 1, and including an additional valve coordinated with one of said additional consumers, a control conduit connected to said second conduit and controlled by said additional valve, said control conduit leading to said one end of said bypass valve and supporting the action of said spring biasing said bypass valve to said first position.

* * * * *